United States Patent [19]

Kleinhany

[11] Patent Number: 4,761,976

[45] Date of Patent: Aug. 9, 1988

[54] LOCK CYLINDER WITH INTEGRATED ELECTROMAGNETIC LOCKING MECHANISM

[75] Inventor: Arno Kleinhany, Hinwil, Switzerland

[73] Assignee: Bauer Kaba AG, Wetzikon, Switzerland

[21] Appl. No.: 555,332

[22] Filed: Nov. 28, 1983

[30] Foreign Application Priority Data

Nov. 26, 1982 [CH] Switzerland ..... 6903/82

[51] Int. Cl.[4] ..... E05B 47/00

[52] U.S. Cl. ..... 70/277; 70/282; 70/380; 70/421; 70/DIG. 62

[58] Field of Search ..... 70/379 R, 379 A, 380, 70/421, 381, 372, DIG. 62, 277–283; 292/359

[56] References Cited

U.S. PATENT DOCUMENTS

| | | | |
|---|---|---|---|
| 288,512 | 11/1883 | Terry | 292/359 |
| 874,438 | 12/1907 | Rautbord | 70/379 R |
| 1,010,727 | 12/1911 | Corbin et al. | 70/379 R |
| 1,464,315 | 8/1923 | Gates | 292/359 |
| 1,695,518 | 12/1928 | Watson | 70/277 |
| 1,832,108 | 11/1931 | Falk | 70/380 |
| 3,599,454 | 8/1971 | Hill | 70/277 X |
| 3,788,110 | 1/1974 | Sugae | 70/380 X |
| 3,939,679 | 2/1976 | Barker et al. | 70/277 |

FOREIGN PATENT DOCUMENTS

| | | | |
|---|---|---|---|
| 2325566 | 12/1974 | Fed. Rep. of Germany . | |
| 2428130 | 2/1980 | France | 70/421 |
| 2024922 | 1/1980 | United Kingdom | 70/277 |

*Primary Examiner*—Kenneth J. Dorner
*Assistant Examiner*—Lloyd A. Gall
*Attorney, Agent, or Firm*—Roylance, Abrams, Berdo & Goodman

[57] ABSTRACT

A lock cylinder with mechanical and electromagnetic locking mechanisms, comprising a lock cylinder stator having a mechanical locking mechanism, a bolt movably mounted in a groove in the stator, and a lock cylinder rotor rotatably coupled to the stator and engaged by the mechanical locking mechanism. An electrical control mechanism controls movement of the bolt. A retaining mechanism coupled to the rotor releasably engages the bolt to permit and prevent movement between the stator and the rotor depending on the position of the bolt.

19 Claims, 2 Drawing Sheets

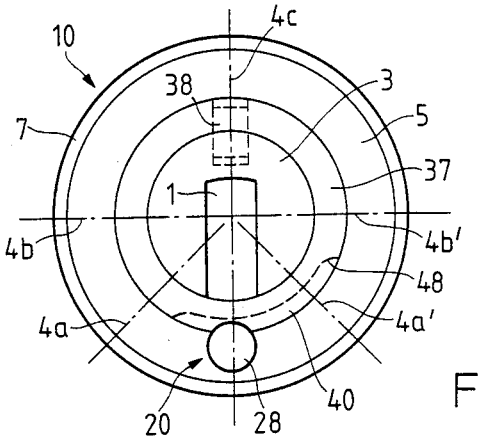
FIG. 1
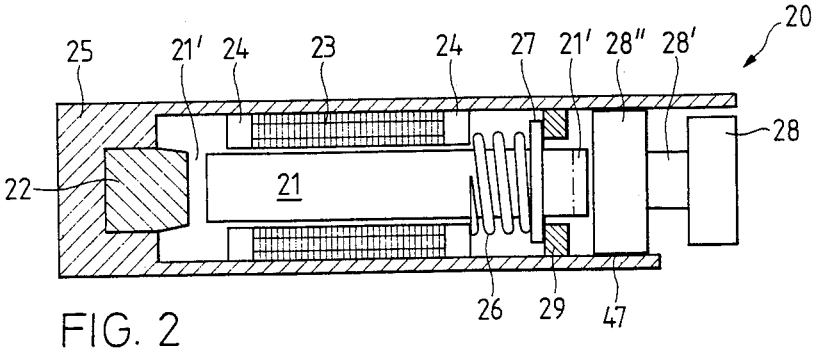
FIG. 2
FIG. 3
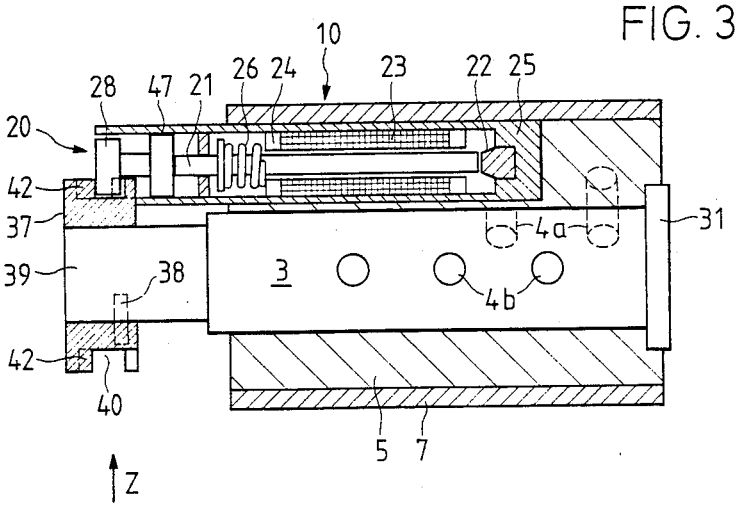

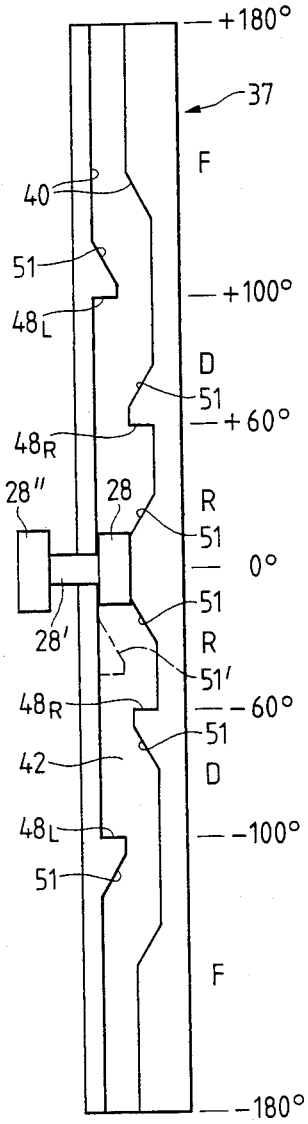
FIG. 4b
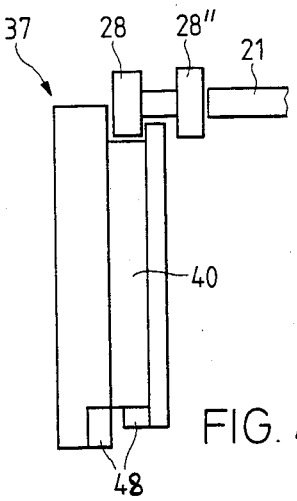
FIG. 4a
FIG. 5
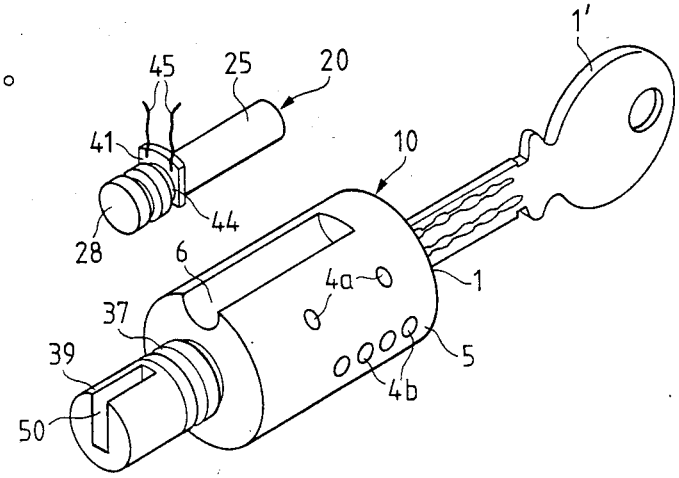

LOCK CYLINDER WITH INTEGRATED ELECTROMAGNETIC LOCKING MECHANISM

FIELD OF THE INVENTION

The present invention relates to a lock cylinder with a mechanical tumbler and an electromagnetic tumbler arranged in the cylinder. The mechanical tumbler is opened by the associated key, while the electromagnetic tumbler is opened by external actuation.

BACKGROUND OF THE INVENTION

Conventional lock cylinders include a first mechanical locking mechanism operated by mechanical means, which first mechanical locking mechanism cooperates with a second mechanical locking mechanism operated by electromagnetic means. Conventionally, the mechanical means for in situ opening of a closure can include a door knob, door latch, keys, etc., while the electromagnetic means actuates the same closure from a remote position.

For example, the independent position of the operating or actuating point for manipulating the electromagnetic means permits a central monitoring of, in part, remotely positioned closures. This monitoring can take place in a time-dependent and fully automatic manner, by the action of an operator, by applying preset states, etc.

In general, the electromagnetic means constitutes a additional closing means, relative to the mechanical means, and is used in a conjunctive or disjunctive manner. These AND and OR possibilities extend the uses of closures, particularly in the organizational manner. This is shown by the following truth table in the case of a door:

| Mechanical | Electromagnetic | |
|---|---|---|
| 0 | 0 | Door open to anybody |
| 1 | 0 | Only key holders have access. |
| 0 | 1 | Access given by control room. |
| 1 | 1 | Control room gives access to certain key holders. |

The two alternative key or control room possibilities extend the organizational possibilities. The conjunctive key and control room possibility increases security.

The advantages of such combined closures are described and used in DE-OS No. 2,325,566. The mechanical means for operating the closure, which is a door closure, are knobs arranged on the door for sliding a bolt. The electromagnetic means operate an additional bolt, which locks or releases the main bolt as a function of the additional bolt position. In addition, a safety cylinder is provided for operating or releasing the electromagnetically operated additional bolt, with the safety cylinder being associated with an interrogation of polling means. The electromagnetic part and the safety cylinder releasing the electromagnetic means are housed in the door frame. The safety cylinder exclusively operates the electromagnetic locking mechanism with the aid of a specially machined notch bit key, which key has the information for the reading device in the key back. The electromagnetic release can also occur disjunctively, i.e., in a key or control room form.

The Journal "Baubeschlag Magazin", No. 10/80 (October 1980) describes another combined closure. An additional bolt operated by electromagnetic means locks the main bolt. The additional mechanical locking mechanism, which is manipulated by means of a safety cylinder using a key, is housed together with the electromagnetic means in the door lock box, not separately in the door and frame. The lock bolt is locked in the rear bolt part and not in the front bolt part.

The locking of a bolt acting between the door and the frame, either by a device in the frame or a device in the door, requires a special design for the closure. For example, subsequently providing an electromagnetic additional locking mechanism in existing closures of any random type, particularly doors, requires modifications to the mechanical part of the lock. Preferably, an existing lock is replaced by one intended for electromagnetic additional locking, or already manufactured therewith.

This replacement involves high costs because otherwise complete locking mechanisms are replaced, often involving additional modifications to existing doors or door frames. The possible additional security is consequently often not used due to the expense, particularly if a relatively large number of closures have to be modified.

SUMMARY OF THE INVENTION

An object of the present invention is to provide a lock cylinder with mechanical and electromagnetic locking mechanisms, which lock cylinder can be easily interchanged in the same closing system with a conventional lock cylinder having standard dimensions without modifying the technical surroundings of the lock.

Another object of the present invention is to provide a lock cylinder which can act on one of the two sides (door sides) separated by the closure, or simultaneously on both sides (door sides) separated by the closure, or with different effects on each side separated by the closure.

A further object of the present invention is to provide a lock cylinder having mechanical variation possibilities and electromagnetically controllable variations, wherein electromagnetic permutations can be associated with the mechanical permutations to ensure adaptability to a very large number of individual closure systems.

The foregoing objects are obtained by a lock cylinder with mechanical and electromagnetic locking mechanisms, comprising a lock cylinder stator having a mechanical locking mechanism, a bolt movably mounted in a groove in the stator, and a lock cylinder rotor rotatably coupled to the stator and engaged by the mechanical locking mechanism. An electrical control mechanism controls movement of the bolt. A retaining mechanism coupled to the rotor releasably engages the bolt to permit and prevent movement between the stator and the rotor depending on the position of the bolt.

Other objects, advantages and salient features of the present invention will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure:

FIG. 1 is a front elevational view of a lock cylinder with mechanically operable tumblers and with an electromagnetically operable tumbler cooperating within the lock cylinder in accordance with the present invention;

FIG. 2 is a side elevational view in section of the electromagnetically operable bolt of the lock cylinder of FIG. 1;

FIG. 3 is a longitudinal view in section of the lock cylinder of FIG. 1 with the retaining ring engaged;

FIG. 4*a* is a plan view of the retaining ring viewed from the direction Z in FIG. 3;

FIG. 4*b* is a plan view of the retaining ring with a cam provided according to another embodiment of the present invention; and FIG. 5 is a perspective, exploded view of a lock cylinder with a key in accordance with the present invention.

DETAILED DESCRIPTION OF THE PREFERRED EMBODIMENTS OF THE INVENTION

FIG. 1 shows the side of a lock cylinder 10 carrying the retaining mechanism. With respect to the perspective view of FIG. 5, the rear part of the lock cylinder which projects into the lock mechanism is illustrated.

The cylinder sleeve 7 defining the lock cylinder has an external circumference corresponding to the standardized dimensions. Thus, a lock cylinder according to the present invention can be used in a conventional lock for replacement, for adding additional locking means to an existing closure or for installing locks in new closures, in which an additional electromagnetic locking mechanism is provided. Thus, existing lock systems can be used without modification.

Within cylinder sleeve 7, a stator 5 is provided having radial bores for the mechanical tumblers to be operated with a key. These mechanical tumblers are graphically illustrated by their tumbler planes. The tumbler planes inclined 45° to the main key plane are designated 4*a*,4*a*'. The tumbler planes inclined 90° to the main key plane are designated 4*b*,4*b*', while the tumbler plane coinciding with the main key plane is designated 4*c*. A rotor 3 has a key channel 1.

A retaining part 28 engages a retaining ring 37 on rotor 3, with the armature 21 in one of its two positions as controlled by the magnetic action. Armature 21 is part of the complete electromagnetic bolt 20, located in a groove 6 running axially in stator 5. The groove for receiving the magnetic bolt is covered and simultaneously pressed by cylinder sleeve 7, so that magnetic bolt 20 is largely prevented from rotating and sliding. The position of the magnetic bolt in stator groove 6 can be secured by various means, e.g., the partial flange 44 shown on bolt 20 in FIG. 5 for the electrical leads 45 for operating the sealed coil of the bolt, the retaining ring 37, or flange 44 and ring 37 together. A connector 38 fixes rotor 3 and retaining ring 37 for simultaneous rotation. Turning of the key in rotor 3 can only rotate the rotor past a defined position, e.g., a point corresponding to a retaining edge in groove 40, when retaining part 28 can freely slide in an axial direction in groove 40 of retaining ring 37.

The details of the magnetic bolt are shown in FIG. 2. A casing 25 is preferably adapted to the shape of groove 6. In its simplest form, casing 25 is cylindrical and surrounds the electrical and mechanical bolt parts. The bobbin 24 carrying the field coil 23 is slid into and fixed in the bolt casing. The soft-iron armature 21 passes through the inner part of coil 23 and has a locking washer 27 fixed at the approximately one third point of its length. The armature is sufficiently large to contact stop 29 provided on the casing end to limit its longitudinal movement. A helical compression spring 26 acting between bobbin 24 and locking washer 27 biases armature 21 toward a defined position relative to casing 25, and therefore also, relative to the lock cylinder rotor 3.

The magnetic field produced by the excited coil moves armature 21 against the armature stop 22, counter to the bias of spring 26. Simultaneously, a longitudinal clearance 21' is provided between armature 21 and the dumbbell-shaped retaining part 28 arranged as a freely movable extension of the armature. This possibility of forward and backward movement of retaining part 28 stops or permits the rotation of the rotor 3 by the retaining part engaging retaining ring 37 fixed to the rotor.

The dumbbell-shaped retaining part 28 has one washer or disk end in retaining ring groove 40. The groove walls are machined to form sliding blocks. By rotating the retaining ring, the complete retaining part can be reciprocated along a rotary or longitudinal axis. The other disk or washer end 28'' is located inside cylindrical casing 25 forming a sliding fit 47 therewith. The "dumbbell" grip forms the connecting part 28' between the disk ends. The constriction formed by part 28' is dimensioned such that part of the retaining ring slides in the space between the disk ends of the reciprocating retaining part 28, with one disk end received in groove 40.

The cooperation of lock cylinder 10 with magnetic bolt 20 or the cooperation of magnetic bolt 20 with rotor 3 is shown in FIG. 3. Casing 25 of magnetic bolt 20 is fixed in groove 6 in stator 5. The front part of the lock cylinder is provided with an entrance flange 31 for the key channel 1. This side is accessible from the outside for the key. The opposite side located within the lock carries the electrically operable locking means with retaining ring 37, sliding groove 40, and retaining part 28. Part of this structure is also formed by rotor end 39 and connector 38 between the rotor and the retaining ring. The mechanical tumblers are indicated by their tumbler planes in FIG. 1. In this representation, retaining part 28 projects into sliding groove 40. After unlocking the mechanical tumblers by means of the key intended for the lock cylinder, rotor 3 can still not be rotated about its axis due to the locking of the retaining part 28 and retaining ring 37.

By action of the current-carrying coil 23, armature 21 is axially drawn back within casing 25 such that retaining part 28 is freely movable within clearance 21' and can be reciprocated by the rotating retaining ring 37. Freeing of retaining part 28 frees rotor 3 so that the rotor is now no longer locked. In this arrangement, the currentless inoperative position of bolt 20 locks rotor 3, i.e., the magnetic bolt must be energized to release the locking means. By reversing retaining ring 37, this action can be reversed so that in a currentless condition, the lock cylinder can be opened with the key without external actuation.

The actuation energy can be reduced by a clearly defined inoperative or neutral state of armature 21 in the immediate vicinity of armature stop 22 to keep movement of the armature caused by the magnetic flux as small as possible. This is obtained through a special construction of the sliding groove 40, as shown e.g. in FIG. 4*b* at 0°±. The lock cylinder can be unlocked with a relatively low current and still have a sufficiently high holding power. This is important in constructions involving small-signal technology.

FIGS. 4*a* and 4*b* show in detail the locking system with retaining ring 37 and retaining part 28. FIG. 4*a* diagrammatically shows how retaining part 28, retaining ring 37 and armature 21 cooperate. Retaining ring 37 is fixed to cylinder rotor 3 and can be driven clockwise or counterclockwise by the rotor. Retaining part 28 is arranged in close contact within sliding groove 40 of retaining ring 37. Retaining part 28 reciprocates in the axial direction of the retaining ring 37 and is moved axially by angled camming surfaces on the walls of sliding groove 40. The free mobility of retaining part 28 is only impaired by the position of magnetic armature 21. In other words, if as a result of an electrical energization, e.g. by a voltage pulse, the armature 21 is drawn away from retaining part 28, then the retaining part can freely move in a translatory manner within the resulting clearance. In the represented example, retaining part 28 is pressed against a wall part of sliding groove 40 by the tension of the helical compression spring 26. Thus, various states can be produced by an on/off function.

A development of sliding groove 40 of retaining ring 37, in conjunction with retaining part 28, is shown in an exemplified manner in FIG. 4*b*. Retaining part 28 is located in a clearly defined neutral or inoperative position at 0°. For example, rotation in direction +180° brings about a closing of the lock, while rotation in the direction −180° brings about an opening thereof. In this embodiment, the construction of the groove permits the same control process during both opening and closing due to the symmetrical design.

If magnet 20 is deenergized, retaining part 28 is pressed against the sliding groove wall, which is to the right of the drawing of FIG. 4*b* by the tension of spring 26. Rotation of retaining ring 37 in each of the two directions would, after approximately 60°, cause blocking against one of the retaining edges $48_R$. However, a 1/6 rotation is not sufficient for a closing or opening process. The same effect would be exerted by the retaining edges $48_L$ on the left-hand side of the sliding groove in the case of a constantly or normally energized magnet.

For initiating a functionally effective rotation, a specific energization pulse length is required, dependent solely on the sliding groove construction. Widened deflectors can require two or more specially defined pulses, to permit an opening of the lock.

In a further development of the sliding groove, a further cam 51', indicated by broken lines in FIG. 4*b*, is provided. The retaining part 28 can be forcibly guided, i.e. can be moved into the retaining position without the aid of a spring tension. The rotor can only further rotate as a result of an energizing pulse of a particular duration and at a specific time.

If in the illustrated embodiment, an attempt is made to open the lock by turning the mechanically correct key in the direction −180°, the magnetic must be energized over a rotation of approximately 60°. Before or on reaching a rotation angle of approximately 100°, the magnet must again be deenergized to prevent a blocking against the retaining edge $48_L$. Phase R from 0° to 60° can be looked upon as the reading phase and phase D from 60° to 100° as the decisive phase. In the case of a possible magnet fault in phase R, a functional rotation would be prevented from the outset, because a decision is no longer possible with faulty magnets.

Based on the above operational characteristics, there are three operative conditions. First, if the current is off (i.e., coil 23 is de-energized), spring 26 pushes armature 21 and retaining part 28 to the right retaining edge of groove 40, as illustrated in FIG. 4*b*, such that rotation is blocked in either direction at the 60° point. Rotation back to the 0° position moves retainer part 28 back to the left retaining edge of groove 40 and armature 21 back against armature stop 22 (see FIG. 3). Second, if current is supplied to coil 23, retaining part 28 remains on the left retaining edge and is not biased by spring 26 since armature 21 is maintained in a retracted position by the energized coil. By remaining on the left retaining edge, part 28 will avoid edge 48*r* in either direction, but will be blocked by edge 48L in either direction with the coil energized after the retaining part passes edge 48*r*. Third, with the current off between the 60° and 100° angular rotations, edge 48L can be avoided for complete opening or closing movement by the rotor.

A key for such lock cylinder should be electrically, as well as mechanically recognizable by the tumbler pins. By providing special ferromagnetic or magnetized parts in the bores provided for this purpose in the key, the key can "transmit" its own code. A reading device, i.e. a receiver, reads and recognizes this code and correspondingly evaluates it. The electronics to be used for this purpose can be housed in the door or in the door frame.

This arrangement considerably increases the closing possibilities. In the case of the effective closure, i.e. solid doors or safety doors, the security increases to the same extent. This device is particularly intended to bring about a greater security against "soft" burglary methods.

The complete arrangement of the magnetic bolt 20, lock cylinder 10, rotor end 39 and the corresponding key is shown in three-dimensional form in FIG. 5. It is only possible to see the cylinder 10 of a lock of a closure. If the lock is to be opened on either side of a door, then a further lock cylinder, facing oppositely to the illustrated lock cylinder, must be provided. Both would be in a position to operate the common lock and both would have mechanical tumblers associated with a corresponding key.

The continuation of the mechanical action of the rotor 3 rotating about its longitudinal axis causes actuation of a lock operator in a lever slot 50 in the rotor end. Appropriately, the lever slot is simply the extension of the key channel 1 in rotor end 39 extending from rotor 3.

The flange 41 for the electrical leads 45 arranged at one end of magnetic bolt 20 only projects slightly radially beyond outside cylinder sleeve 7. As indicated, it can also be used for securing the position of bolt 20 in stator 5. However, it is even more advantageous to have the partial flange 44 adapted to engage rotor end 39, or a shaping of the magnetic bolt casing 25 adapted to the axial groove 6 in stator 5.

It is now possible to equip only one of the two door sides with a lock cylinder according to the invention. An authorized person is then allowed to enter by means of the magnetic bolt actuation, which can take place from a control room, and can at any time pass through the same door from the inside to the outside. Conversely, the key holder can obtain access at any time but, in order to get out again, must actuate the magnetic bolt. This, in principle, the following relationship can be drawn up:

| Door | In | Out | |
|---|---|---|---|
| 1. | M | M | Actuate magnetic bolt to get in and out. |
| 2. | O | M | Only exit must be requested. |
| 3. | M | O | Only entrance must be requested. |
| 4. | O | O | Key sufficient for getting in and out. |

This illustrates an advantage of the invention. By simply replacing one or other or both lock cylinders, an existing closure can be conditioned according to the table so that its control and security are improved. The corresponding leads can easily be passed through passages in the hinge from the door into the frame according to conventional arrangements.

While various embodiments have been chosen to illustrate the invention, it will be understood by those skilled in the art that various changes and modifications can be made therein without departing from the scope of the invention as defined in the appended claims.

What is claimed is:

1. A lock cylinder with mechanical and electromagentic locking mechanisms, comprising:

a lock cylinder stator having mechanical locking means and a stator groove;

a bolt movably mounted in said stator groove between first and second positions, said bolt including an armature movable in a translatory manner and a retaining part arranged at one end of said armature for movement relative to said armature;

electrical control means, operably coupled to said bolt, for controlling movement thereof;

a lock cylinder rotor rotatably coupled to said stator and engaged by said mechanical locking means; and retaining means, coupled to said rotor, for releasably engaging said bolt to permit and prevent relative movement between said stator and said rotor depending on the position of said bolt, said retaining means including a retaining ring fixed to said rotor for simultaneous rotation therewith, said retaining ring having a sliding groove receiving said retaining part.

2. A lock cylinder according to claim 1 wherein said stator groove has a median longitudinal plane; and said stator has tumblers having median longitudinal planes at substantially equal angles to said median longitudinal plane of said stator groove on opposite sides thereof.

3. A lock cylinder according to claim 1 wherein one portion of said sliding groove in said retaining ring forces said retaining part against said armature moving said armature adjacent an armature stop.

4. A lock cylinder according to claim 1 wherein said bolt comprises a spring biasing said armature toward an extended position spaced from an armature stop, said electrical control means moving said armature against the bias of said spring toward said armature stop.

5. A lock cylinder according to claim 1 wherein said sliding groove in said retaining ring has a first retaining edge which engages said retaining part when said electrical control means is energized and a second retaining edge which engages said retaining part when said electrical control means is deenergized, engagement of said retaining part with one of said retaining edges preventing relative movement of said stator and said rotor.

6. A lock cylinder according to claim 1 wherein said retaining part is moved along a longitudinal axis by relative movement of said retaining part in said sliding groove, said movement being permitted by a space between said armature and said retaining part.

7. A lock cylinder according to claim 6 wherein said sliding groove in said retaining ring comprises a cam for guiding longitudinal movement of said retaining part.

8. A lock cylinder according to claim 6 wherein said sliding groove in said retaining ring has at least one retaining edge which engages said retaining part to prevent further relative rotation of said stator and said rotor.

9. A lock cylinder according to claim 6 wherein said sliding groove in said retaining ring has a first retaining edge which engages said retaining part when said electrical control means is energized and a second retaining edge which engages said retaining part when said electrical control means is deenergized.

10. A lock cylinder according to claim 6 wherein one portion of said sliding groove in said retaining ring forces said retaining part against said armature moving said armature adjacent an armature stop.

11. A lock cylinder with mechanical and electromagnetic locking mechanisms, comprising:

a lock cylinder stator having mechanical locking means and a stator groove;

a bolt movably mounted in said stator groove between first and second positions, said bolt including an armature movable in a translatory manner and a retaining part arranged at one end of said armature;

electrical control means, operably coupled to said bolt, for controlling movement thereof;

a lock cylinder rotor rotatably coupled to said stator and engaged by said mechanical locking means; and retaining means, coupled to said rotor, for releasably engaging said bolt to permit and prevent relative movement between said stator and said rotor depending on the position of said bolt, said retaining means including a retaining ring fixed to said rotor for simultaneous rotation therewith, said retaining ring having a sliding groove receiving said retaining part, said sliding groove in said retaining ring having a first retaining edge which engages said retaining part when said electrical control means is energized and a second retaining edge which engages said retaining part when said electrical control means is deenergized, engagement of said retaining part with one of said retaining edges preventing relative movement of said stator and said rotor.

12. A lock cylinder according to claim 11 wherein one portion of said sliding groove in said retaining ring forces said retaining part against said armature moving said armature adjacent an armature stop.

13. A lock cylinder according to claim 11 wherein said bolt comprises a spring biasing said armature toward an extended position spaced from an armature stop, said electrical control means moving said armature against the bias of said spring towards said armature stop.

14. A lock cylinder with mechanical and electromagnetic locking mechanisms, comprising:

a lock cylinder stator having mechanical locking means and a stator groove;

a bolt movably mounted in said stator groove between first and second positions, said bolt including an armature movable in a translatory manner and a retaining part arranged at one end of said armature;

electrical control means, operably coupled to said bolt, for controlling movement thereof;

a lock cylinder rotor rotatably coupled to said stator and engaged by said mechanical locking means; and retaining means, coupled to said rotor, for releasably engaging said bolt to permit and prevent relative movement between said stator and said rotor depending on the position of said bolt, said retaining means including a retaining ring fixed to said rotor for simultaneous rotation therewith, said retaining ring having a sliding groove receiving said retaining part, said sliding groove being defined by first and second annular side walls, said first side wall having a first projection extending into said sliding groove with a first retaining edge extending substantially perpendicular from said first side wall for engaging said retaining part when said control means is energized, said second side wall having a second projection extending into said sliding groove with a second retaining edge extending substantially perpendicular from said second side wall for engaging said retaining part when said control means is deenergized, engagement of said retaining part with one of said retaining edges preventing relative movement of said stator and rotor.

15. A lock cylinder according to claim 14 wherein pairs of first and second projections are provided in said sliding groove in mirror image symmetry.

16. A lock cylinder according to claim 14 wherein said projections have camming surfaces on sides thereof opposite the respective retaining edge such that said projections taper toward the opposite side wall.

17. A lock cylinder according to claim 14 wherein said retaining part is slidable relative to said armature.

18. A lock cylinder according to claim 14 wherein one portion of said sliding groove in said retaining ring forces said retaining part against said armature moving said armature adjacent an armature stop.

19. A lock cylinder according to claim 14 wherein said bolt comprises a spring biasing said armature toward an extended position spaced from an armature stop, said electrical control means moving said armature against the bias of said spring towards said armature stop.

* * * * *